US009516901B2

(12) United States Patent
Schoenbeck et al.

(10) Patent No.: US 9,516,901 B2
(45) Date of Patent: Dec. 13, 2016

(54) PAIR OF COMPLEMENTARY ARTICLES OF CLOTHING

(71) Applicant: ST. ANTONI LLC, München (DE)

(72) Inventors: Dewi Schoenbeck, München (DE); John Schoenbeck, München, CA (US)

(73) Assignee: ST. ANTONI LLC, Muchen (DE)

( * ) Notice: Subject to any disclaimer, the term of this patent is extended or adjusted under 35 U.S.C. 154(b) by 322 days.

(21) Appl. No.: 14/177,060

(22) Filed: Feb. 10, 2014

(65) Prior Publication Data

US 2014/0220291 A1 Aug. 7, 2014

Related U.S. Application Data

(63) Continuation of application No. 13/941,348, filed on Jul. 12, 2013, now abandoned, which is a continuation of application No. PCT/EP2012/000106, filed on Jan. 11, 2012.

(30) Foreign Application Priority Data

Jan. 13, 2011 (DE) ..... 10 2011 008 470

(51) Int. Cl.
*A41B 11/00* (2006.01)
*A41D 19/00* (2006.01)

(52) U.S. Cl.
CPC ..... *A41B 11/002* (2013.01); *A41D 19/0034* (2013.01); *Y10T 428/24008* (2015.01)

(58) Field of Classification Search
CPC ..... A41B 11/001; A41B 11/002; A41D 27/08; A44B 17/0029; A44B 17/0041
See application file for complete search history.

(56) References Cited

U.S. PATENT DOCUMENTS

| | | | |
|---|---|---|---|
| 3,699,617 | A | 10/1972 | Hofmeister |
| 4,165,555 | A | 8/1979 | Boxer et al. |
| 5,038,413 | A | 8/1991 | Ursino |
| 5,699,557 | A | 12/1997 | Johnson |
| 5,740,558 | A | 4/1998 | Messman |
| 5,918,318 | A | 7/1999 | Jones |

(Continued)

FOREIGN PATENT DOCUMENTS

| | | | |
|---|---|---|---|
| DE | 3803799 | A1 | 8/1989 |
| DE | 10010656 | A1 | 9/2001 |

(Continued)

OTHER PUBLICATIONS

Notice of Allowance for U.S. Appl. No. 29/494,543 mailed Dec. 8, 2014.

(Continued)

*Primary Examiner* — Daniel Wiley
(74) *Attorney, Agent, or Firm* — Brooks Acordia IP Law, P.C.; Douglas N. Larson

(57) ABSTRACT

A pair of complementary articles of clothing, such as socks, that can be detachably connected to each other. The detachable connection can be made by first and second complementary connecting elements, which are each fastened to the article of clothing by a carrier element, wherein one of the ends of each carrier element forms a gripping area without a connecting function, so that the connection between the first and the second connecting element can be detached by pulling on the gripping areas of the carrier elements.

26 Claims, 8 Drawing Sheets

(56) References Cited

U.S. PATENT DOCUMENTS

| | | | | |
|---|---|---|---|---|
| 5,970,524 | A | 10/1999 | Becker et al. | |
| 5,974,590 | A | 11/1999 | Stubbs | |
| 6,032,294 | A | 3/2000 | Dean | |
| 6,092,241 | A | 7/2000 | Bellet | |
| 6,185,745 | B1 | 2/2001 | Alger | |
| 6,185,751 | B1 | 2/2001 | Mason | |
| 6,216,279 | B1 | 4/2001 | Ellingson | |
| 6,237,158 | B1 | 5/2001 | Barbara | |
| 6,374,420 | B2 | 4/2002 | Jossi | |
| 6,397,393 | B2 | 6/2002 | Alger | |
| 6,463,636 | B1 * | 10/2002 | Friedewald | A41B 11/002 24/2 |
| D473,706 | S | 4/2003 | Livingston-Capoano | |
| D511,888 | S | 11/2005 | Anton et al. | |
| 6,990,694 | B2 | 1/2006 | Poole | |
| 7,058,986 | B2 | 6/2006 | Pietzyk-Hardy | |
| 7,150,081 | B2 | 12/2006 | Juan | |
| 7,302,712 | B2 | 12/2007 | Abrusia et al. | |
| 8,359,671 | B1 | 1/2013 | Glass et al. | |
| 2004/0123377 | A1 | 7/2004 | Ferguson | |
| 2004/0123430 | A1 | 7/2004 | Ferguson | |
| 2004/0154075 | A1 | 8/2004 | Ferguson | |
| 2007/0256280 | A1 | 11/2007 | Azan | |
| 2008/0034478 | A1 | 2/2008 | Patterson | |
| 2008/0222778 | A1 | 9/2008 | Dierssen-Morice et al. | |
| 2010/0011486 | A1 | 1/2010 | Allen | |
| 2011/0209268 | A1 | 9/2011 | Smitherman | |
| 2012/0311768 | A1 | 12/2012 | Ladyzhenskaya et al. | |
| 2013/0302558 | A1 | 11/2013 | Schoenbeck et al. | |
| 2014/0090149 | A1 | 4/2014 | Zuiderveen et al. | |

FOREIGN PATENT DOCUMENTS

| | | | |
|---|---|---|---|
| FR | 2840511 | A1 | 12/2003 |
| WO | WO 2012/095310 | A1 | 7/2012 |

OTHER PUBLICATIONS

PCT/EP2012/000106, International Search Report mailed Mar. 22, 2012.

* cited by examiner

PAIR OF COMPLEMENTARY ARTICLES OF CLOTHING

CROSS REFERENCE TO RELATED APPLICATIONS

This is a continuation of copending U.S. application Ser. No. 13/941,348, filed Jul. 12, 2013, and which is a continuation of International Application PCT/EP/2012/00106 which was filed on Jan. 11, 2012 and published on Jul. 19, 2012 as WO 2012/095310 and which claims the filing date benefit of German application 10 2011 008 470.3, filed Jan. 13, 2011, and which in turn has a publication date of grant of Jul. 4, 2013, as German patent No. 10 2011 008 470. The entire contents of all of these applications are hereby incorporated by reference.

BACKGROUND

The present invention relates to a pair of complementary articles of clothing, in particular a pair of socks, comprising first and second complementary articles of clothing that can be detachably connected to each other. Here, the detachable connection is made by first and second complementary connecting elements, which are each fastened to the respective article of clothing by a respective carrier (or bearing) element.

Numerous attempts to fit socks with connecting elements which allow the two socks of the pair of socks to be detachably connected in order to prevent the loss of a sock when washing and storing the socks are disclosed in the prior art. For example, it is known to arrange press-studs on the socks, which enables the two socks of a pair to be detachably connected together.

However, prior art embodiments have the problem that when detaching the detachable connection, high forces act on the material of the sock at the point where the connecting elements are fastened, thereby damaging the sock and shortening the useful life of the sock. Furthermore, the user must use special care when connecting and detaching the socks to protect the connecting mechanism of prior art constructions.

SUMMARY

An object of the disclosure is therefore to provide a pair of articles of clothing that can be detachably connected to each other and with which the connecting mechanism has a long life and is easy for the operator to use.

According to the disclosure, this object can be achieved by a pair of complementary articles of clothing that comprise first and second complementary articles of clothing which can be detachably connected to each other. The detachable connection is made by first and second complementary connecting elements, which are each fastened to the article of clothing by a carrier (or bearing) element. One of the ends of each of the carrier elements forms a gripping area without a connecting function, so that the connection between the first and the second connecting elements can be detached by pulling on the gripping areas of the carrier elements.

Unlike conventional socks that can be detachably connected to each other, the connection of the present disclosure cannot be detached by the user pulling on the socks and thus detaching the connection, which, in the prior art caused very high stressing of the material when detaching. Rather, the user herein detaches the connection between the two socks by pulling on the gripping areas of the carrier elements. The force is thereby transmitted directly from the carrier elements to the connecting elements arranged thereon without damaging the material of the articles of clothing.

Because the ends of the carrier elements have respective gripping areas that do not have a connecting function, it is immediately and intuitively clear to the user where he applies the force to detach the connection. This construction also provides the user with an improved operating sensation, as the connection can be easily and safely detached by taking hold of the gripping areas without special care being necessary when detaching.

The use of a carrier element with gripping area has an advantage that, unlike the material of the article of clothing, this can be designed for a mechanical, manual use of connection and detachment. In doing so, the stability of the carrier material can be higher than that of the material of the article of clothing and therefore sufficiently mechanically stable to transmit the forces necessary for detachment.

By the choice of material and the surface treatment, a user-friendly, non-slip, gripping surface, such as with a rough surface, can be produced, which simplifies use. As the gripping area has no connecting function, it can be flat, without any raised portions. The carrier element can consist of a flexible and/or elastic, preferably heat and water-resistant plastic or an appropriate textile material, such as a webbing material, interlaced yarn or knitted fabric.

The carrier element can function as a decorative element which visually clarifies the affiliation of the articles of clothing and also provides many and varied ways of disseminating information, in particular manufacturer and product information such as manufacturer, brands, logos, claims, clothing size, indication of left or right article of clothing, manufacturing date or place, material information, any product information, and user's personal information such as name, initials, date of birth, etc. Depending on the material of the carrier element, this information can, for example, be printed, sewn on, knitted on, lasered, stamped out, embossed, engraved, milled, etc.

The carrier element can be removed from the sock when the sock or fastener system is worn out according to an embodiment herein. The sock can therefore be disposed of and if appropriate recycled separately. The connecting system can similarly be disposed of, recycled or if appropriate reused separately.

The present disclosure can be used for detachably connecting pairs of socks. Furthermore, the present disclosure can also be used for gloves, gauntlets or other complementary articles of clothing. Advantageously, the present disclosure can also be used for such articles of clothing that are made of a knitted fabric or webbing material, as the advantages herein regarding material preservation particularly also apply to such articles of clothing.

Advantageously, the carrier elements can be made of a flexible plastic or a flexible textile material. Further advantageously, the carrier elements can be joined to the material of the article of clothing by sewing, welding, hot-sealing or gluing. Even further, at least over part of their extent, the carrier elements lie flat on the material of the article of clothing and are joined thereto, for example by gluing, hot-sealing, welding or a circumferential fold.

At the same time, the carrier element can be fastened to the sock in the area of the cuff. In doing so, the carrier element can be attached to the outside of the cuff on one side. Advantageously however, the carrier element encompasses the cuff of the sock from the outside and the inside.

In doing so, the connecting elements are advantageously fastened on the carrier element, such as by riveting, sewing, welding or gluing, or are already integrated therein. The connecting elements can be arranged in the area in which the carrier elements lie flat on the material of the article of clothing.

The connecting elements can be made of heat-resistant plastic and/or metal. The configuration of the connecting elements can withstand the tensile, shear and torsional forces that occur during the washing process.

Pursuant to one embodiment herein, the first and the second connecting elements are designed so that they produce a non-twistable connection between the articles of clothing. This ensures that, in the connected state of the articles of clothing, the ends of the carrier elements that form the gripping areas remain in a unique spatial association with respect to each other and are unable to twist relative to each other, such as when being washed. The non-twistability of the connection ensures that the gripping areas are always in a clear spatial relationship with respect to each other for the user, and the socks can therefore be detached from one another by the user applying force to the gripping areas. This ensures that the user does not pull on the material of the article of clothing when he wants to detach the connection. Advantageously, the connecting elements are designed and arranged on the carrier elements in such a way that they allow a connection of the articles of clothing with which the gripping areas are arranged next to each other.

Additionally, the first connecting element can be arranged on the carrier element of the first article of clothing in a connecting area that is arranged next to the gripping area, and the second connecting element that is complementary to the first connecting element can be arranged on the carrier element of the second article of clothing, similarly in a connecting area that is arranged next to the gripping area. Advantageously, the connecting elements are designed so that they only allow a connection of the two articles of clothing in one or a few unique positions, in particular in one to four positions, further advantageously in only one position. As a result, the gripping areas are arranged spatially uniquely with respect to each other in the connected state.

At the same time, the first and the second connecting elements can be designed as a push-fit connector with male and female elements, wherein the male element engages in a stud-like manner in the female element. Advantageously, the material of the connecting element can be elastic, so that the male element can be pushed into the female element. Further advantageously, the male element can have an undercut that secures it to the female element. In particular, the male element can have a mushroom shape in cross section with an enlarged head area. Alternatively, a conventional press-stud with spring can be used.

In an advantageous manner, the male and female elements can each consist of two or more connecting sections or points arranged next to each other, or of at least one non-rotationally-symmetrical connecting section or point. By this means, the non-twistable connection between the two connecting elements can be ensured. If a plurality of connecting sections are used and are arranged next to each other, they can each be designed to be rotationally symmetrical and yet allow a non-twistable connection. Alternatively or in addition, non-rotationally-symmetrical connecting sections, such as line elements for example, can also be used in order to guarantee a non-twistable connection.

As an example, the first and the second connecting elements can each be constructed as a single part. Particularly when each connecting element has a plurality of connecting sections or points, then they are advantageously arranged on a common base plate. In particular, the first and the second connecting element are each designed in one piece that is produced integrally.

Advantageously, the connecting elements can be made of a torsionally stiff material. Particularly when using a plurality of connecting sections or points, this ensures that all connecting sections or points are also actually connected to each other when closing the connection and a non-twistable connection results.

In particular, the connecting elements can be made of plastic and/or metal, wherein advantageously the first and second connecting elements are each formed in one piece. In particular, the connecting elements here can be injection molded parts, the connecting elements can be produced using a two-component injection molding method.

The connecting elements can simultaneously be used as logos. Both the shape of the male and female connecting sections of the connecting elements as well as the color of the connecting elements and also a picture or word trademark in the form of a graphical application can be used for this purpose.

In a preferred embodiment the gripping area of the carrier elements is in each case situated at a first end of the carrier element which is arranged in the area of the cuff of the article of clothing, in particular the sock. On the other hand, the connecting element can be arranged at the opposite end of the carrier element, which is arranged flat on the material of the article of clothing.

At the same time, the end of the carrier element that forms the gripping area can end at the cuff of the article of clothing or protrude beyond the cuff. Alternatively, the system with gripping area and connecting element can also be aligned parallel to the cuff of the article of clothing with the gripping area positioned next to the connecting element. In both cases, this results in a self-explanatory application of the fastener (clear product semantics), whereby the user intuitively knows where he must introduce the force to open the connection.

The carrier element can comprise a flat, in particular strip-shaped, square or round element, wherein the carrier element is either not folded or wherein two fold sections of the element are folded on top of each other by a fold in the area of the cuff and joined to each another directly or indirectly over their length. The gripping area is therefore formed either by the unfolded end of the carrier element or by the fold of the element which is arranged in the area of the cuff. If an element with two fold sections is used, the stability of the carrier element is increased by the connection of the two fold sections to each other and thereby the doubling of the material.

In one embodiment, the carrier element here can be fastened on the outside of the sock, for example by riveting, sewing, gluing or welding.

In an alternative embodiment, the two fold sections of the carrier element can encompass the cuff of the article of clothing in the form of a wrap from the inside and outside. In this way, the carrier element can be connected to the textile material of the article of clothing particularly from the inside and from the outside. This results in a very stable connection, with which only very low loads are exerted on the material of the article of clothing when disconnecting. In particular, in doing so, the two fold sections can be sewn or riveted to each other through the material of the article of clothing. The material of the carrier element therefore bears the main load of the connection to the article of clothing.

In a first embodiment, the connecting element can be integrated in the carrier element. Advantageously, in doing so, the carrier element can be arranged on the outside of the article of clothing.

In contrast in another embodiment, the connecting element can be made separately and subsequently fastened to the carrier element, for example by riveting, sewing, gluing or welding.

The carrier element can also be made in several parts. For example, a first element of the carrier element can be applied directly to the article of clothing, while a second element carries the connecting element and is fastened to the first element, wherein the connecting element can be integrated in the second element.

As well as the pair of complementary articles of clothing, such as a pair of socks, a carrier element for such a pair of complementary articles of clothing is disclosed herein. Here, the carrier element has the same advantages as described above with respect to the pair of complementary articles of clothing. The connecting element can be arranged on the carrier element in each case, wherein one of the ends of the carrier element forms a gripping area without a connecting function. Furthermore, a set of two carrier elements, each having complementary connecting elements, can be included wherein the connection between the first and the second connecting element can be detached by pulling on the gripping areas of the respective carrier elements.

1. Disclosed herein is a pair of complementary articles of clothing, in particular a pair of socks, comprising first and second complementary articles of clothing, which can be detachably connected to each other, wherein the detachable connection is made by first and second complementary connecting elements, which are each fastened to the article of clothing by a carrier element, characterized in that one of the ends of each carrier element forms a gripping area without a connecting function, so that the connection between the first and the second connecting element can be detached by pulling on the gripping areas of the carrier elements.

2. Also disclosed is a pair of complementary articles of clothing of the immediately above paragraph 1 wherein the first and the second connecting elements produce a non-twistable connection between the articles of clothing so that in the connected state of the articles of clothing, the ends of the carrier elements which form the gripping areas remain in a unique spatial association with respect to each another.

3. Also disclosed is a pair of complementary articles of clothing of paragraphs 1 or 2 wherein the first and the second connecting elements are configured as a push-fit connector with a male and a female element, wherein the male element engages in a stud-like manner in the female element and has an undercut.

4. Also disclosed is a pair of complementary articles of clothing of paragraphs 2 or 3 wherein the male and female elements each comprise a plurality of sections arranged next to each other, or at least one non-rotationally-symmetrical section.

5. Also disclosed is a pair of complementary articles of clothing of paragraphs 2, 3 or 4 wherein the first and the second connecting elements are each designed as one part and preferably in one piece.

6. Also disclosed is a pair of complementary articles of clothing of paragraphs 2, 3, 4 or 5 wherein the connecting elements are made of a torsionally stiff material.

7. Also disclosed is a pair of complementary articles of clothing of paragraphs 2, 3, 4, 5 or 6 wherein the connecting elements are made of plastic and/or metal, wherein the first and the second connecting elements are each in one piece.

8. Also disclosed is a pair of complementary articles of clothing of any of paragraphs 1 through 7 wherein the gripping area is in each case situated at a first end of the carrier element which is arranged in the area of the cuff of the article of clothing, while the connecting element is arranged at the opposite end of the carrier element which is arranged in the area of the article of clothing.

9. Also disclosed is a pair of complementary articles of clothing of any of paragraphs 1 through 8 wherein the carrier element comprises a flat element, wherein the carrier element is not folded or wherein two fold sections of the element are folded on top of each another by a fold in the area of the cuff and joined to each another directly or indirectly over their lengths, wherein the two fold sections encompass the cuff of the article of clothing in the form of a wrap from the inside and outside.

10. Also disclosed is a pair of complementary articles of clothing of any of paragraphs 1 through 9 wherein the connecting element is integrated in the carrier element, and the carrier element is positioned on the outside of the article of clothing.

11. Also disclosed is a pair of complementary articles of clothing of any of paragraphs 1 through 10, wherein the connecting element is made separately and subsequently fastened to the carrier element.

12. Also disclosed is a carrier element having a connecting element for a pair of complementary articles of clothing of any of paragraphs 1 through 11.

13. Also disclosed is a set of two carrier elements for a pair of complementary articles of clothing of any of paragraphs 1 through 12.

BRIEF DESCRIPTION OF THE DRAWINGS

The present inventions are now described in more detail with reference to exemplary embodiments and drawings wherein.

DETAILED DESCRIPTION

Figure 1:
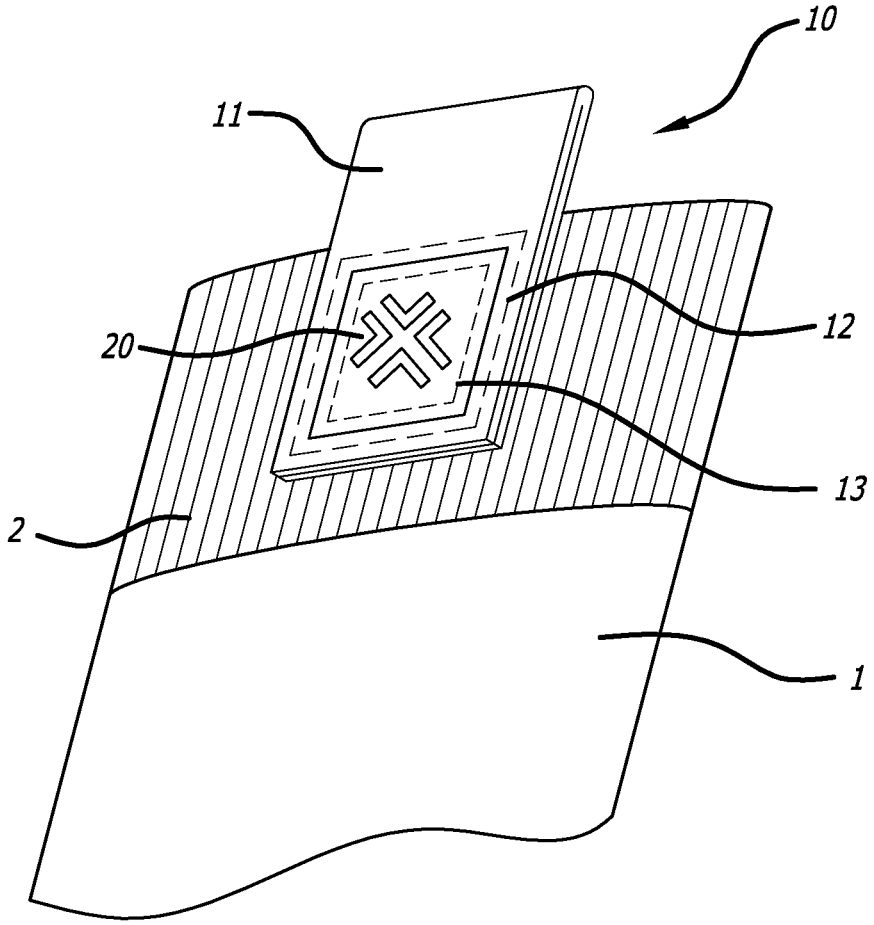
FIG. 1 shows a top portion of a first exemplary embodiment of an article of clothing having a carrier element of the present disclosure.

The present inventions according to an aspect thereof allow the temporary connection of articles of clothing, in particular socks, such as during the washing process and during storage, by a connecting system attached to the articles of clothing.

Here, the connection is carried out by connecting elements arranged on carrier (or bearing) elements to prevent the connecting elements pulling out of the material of the articles of clothing. For this purpose, one end of the carrier elements forms a gripping area which has no connecting function and on which therefore no connecting element is arranged. This results in unique product construction wherein it is obvious to the user where he is to introduce the force. At the same time, the carrier element suggests stability to the user with regard to the connection and detachment of the socks. As a result, the user can confidently use the system without having to use special care to detach the connection.

Exemplary embodiments of such connecting systems are presented in greater detail below based on socks that can be detachably connected to each other. The connecting systems shown can also be used with complementary articles of clothing other than socks.

A first exemplary embodiment is shown in more detail in FIGS. 1, 2A, 2B and 2C. Here, a carrier element 10 is fastened, in the exemplary embodiment sewn by seam 12, to a sock 1 in the area of the cuff 2. The carrier element 10 comprises a strip-shaped flexible material, which is folded over at the top and fastened to the cuff 2 with a double thickness. The one end of the carrier element thus forms a gripping area 11, which in the exemplary embodiment projects beyond the edge of the sock. A connecting element 20 is fastened, in the exemplary embodiment likewise by means of a seam 13, on the carrier element 10 in the area in which it is fastened to the sock. In the exemplary embodiment, the connecting element 20 is only fastened to the carrier element 10, and the carrier element 10 in turn to the knitted fabric of the sock.

Figure 2A:
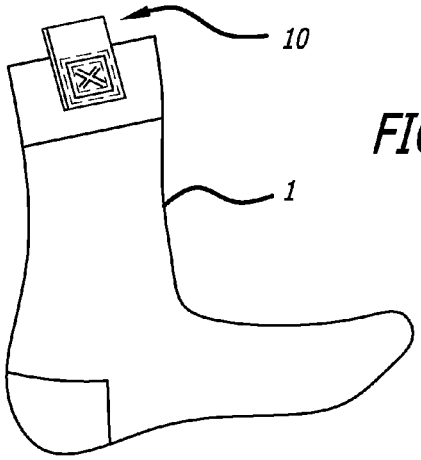
FIG. 2A is a side elevational view of a pair of complementary articles of clothing according to the embodiment of FIG. 1.
Figure 2B:
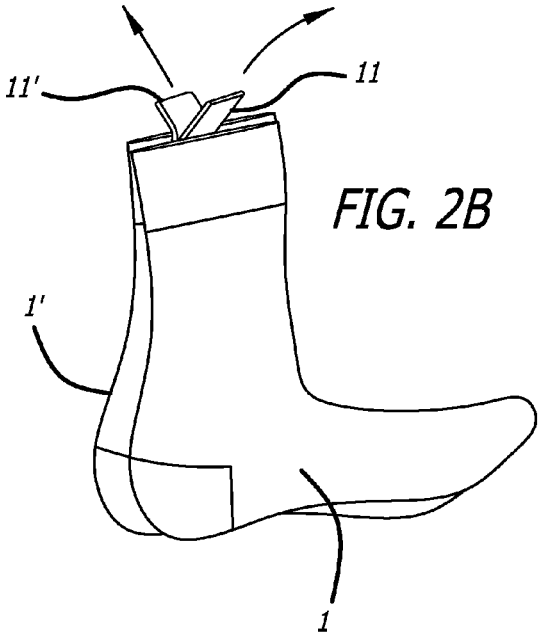
FIG. 2B is a view similar to FIG. 2A showing the tab gripping portions being pulled apart.
Figure 2C:
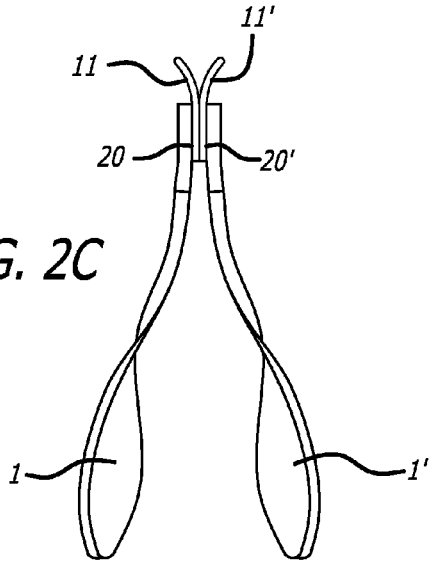
FIG. 2C is an edge elevational view of FIG. 2B.

As can be seen particularly from FIGS. 2A, 2B and 2C, which show a pair of socks according to the disclosure comprising a first sock 1 and a second sock 1' having a corresponding first carrier element 11 and a second carrier element 11' and connecting elements 20 and 20' arranged thereon, a particularly easy and safe detachment of the connection between the socks is thereby enabled. As the gripping areas 11 and 11' of the respective carrier elements do not have a connecting function, it is intuitively clear to the user that he must apply the force (see the arrows in FIG. 2B) here for detaching the connecting elements which are arranged adjacent thereto. As a result, virtually no load/force is applied to the knitted fabric of the sock when detaching the connection.

At the same time, the connecting elements 20 and 20' are designed so that the connection is non-twistable. This ensures that, even after washing, the gripping areas 11 and 11' are still in the spatial arrangement with respect to each other which is necessary for intuitively correct use, and in particular are arranged next to each other.

Figure 3A:
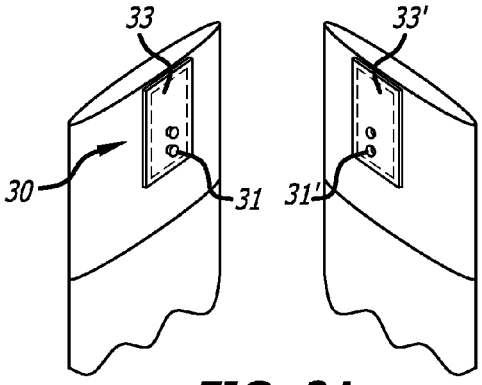
FIG. 3A is a top perspective view of a second exemplary embodiment of a pair of complementary articles of clothing in which the connecting elements are integrated in the carrier elements.
Figure 3B:
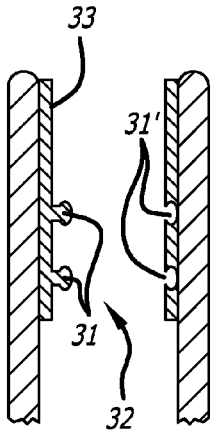
FIG. 3B is a cross-sectional side elevational view of FIG. 3A.

A further exemplary embodiment in which the carrier element 30 is fastened to the outside of the sock is shown in FIGS. 3A and 3B. Here, the connecting element is integrated in the carrier element 30. At the same time, the carrier element is sewn to the material of the sock in each case. The connecting element in turn has studs 31 which engage in recesses 31' on the other connecting element. At the same time, the area 33 forms the gripping area of the carrier element, and the area 32 forms the connecting element in the carrier element.

Two further exemplary embodiments, in which the carrier element is fastened both to the inside and to the outside of the sock, are shown in FIGS. 4A and 4B and 4C and 4D. This results in a lesser force acting on the knitted fabric itself when pulling the socks apart. In the exemplary embodiment of FIGS. 4A and 4B, the connecting system 40 is folded from a continuous, strip-shaped material with an outer fold section 44 on the outside and with an inner fold section 45 on the inside of the sock so that it encompasses the cuff of the sock. The fold sections are each glued, welded, or heat-sealed or sewn to the material of the sock.

In this exemplary embodiment, the connecting elements 42 and 42' are arranged on the outside in the lower part of the carrier element. The top part thus forms a gripping area 43, and the bottom part the connecting element. In this exemplary embodiment, the connecting elements are at the same time integrated in the material of the carrier element. In particular here, the one carrier element has studs 41 that can be pushed into recesses 41' of the other carrier element.

Figure 4A:
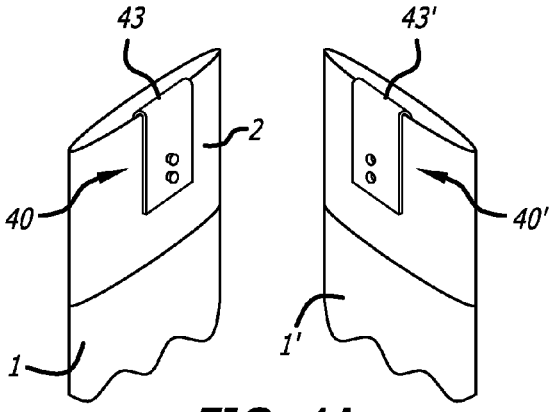
FIG. 4A is a top perspective view of a third exemplary embodiment of a pair of complementary articles of clothing in which the connecting elements are integrated in the carrier elements.
Figure 4B:
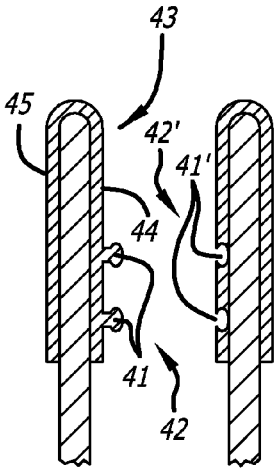
FIG. 4B is a cross-sectional side elevational view of FIG. 4A.
Figure 4C:
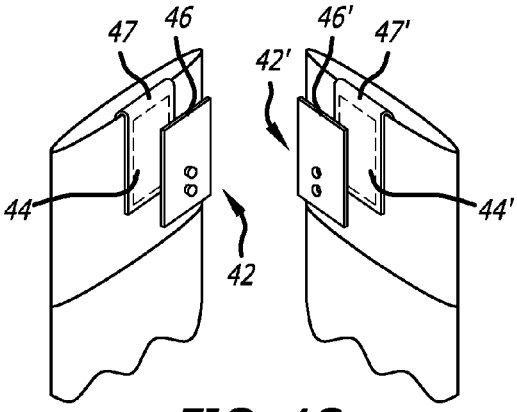
FIG. 4C is a top perspective view of a fourth exemplary embodiment of a pair of complementary articles of clothing in which carrier and connecting elements are designed in two parts.
Figure 4D:
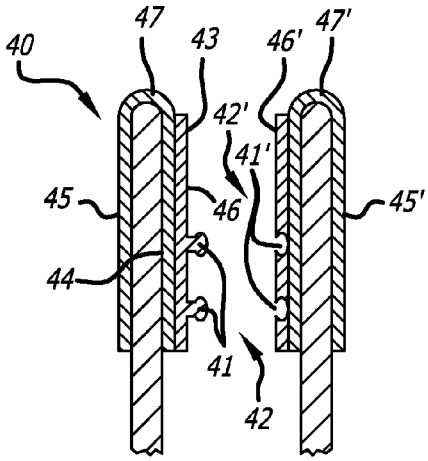
FIG. 4D is a cross-sectional side elevational view of FIG. 4C.

In the exemplary embodiment shown in FIGS. 4C and 4D the connecting system 40 is made up in two parts from a carrier element 47, which encompasses the cuff of the sock with the two fold sections 44 and 45, and a second element 46, which carries the connecting element. In this exemplary embodiment, the first element 47 is sewn to the sock. The connecting element 42 is integrated in the second element 46, which is fastened to the outer fold section 44 of the carrier element, in particular glued, riveted or sewn thereto. The connecting element 42 in turn has studs 41 that engage in recesses 41' on the other connecting element 42'. In this exemplary embodiment, the second element 46, which carries the connecting element, extends the entire length of the carrier element 40 on the outside of the sock so that a bottom part of the second element 46 forms the connecting element 42, and the part of this element that lies above it forms the gripping area 43 of the carrier element 40.

Figure 4E:
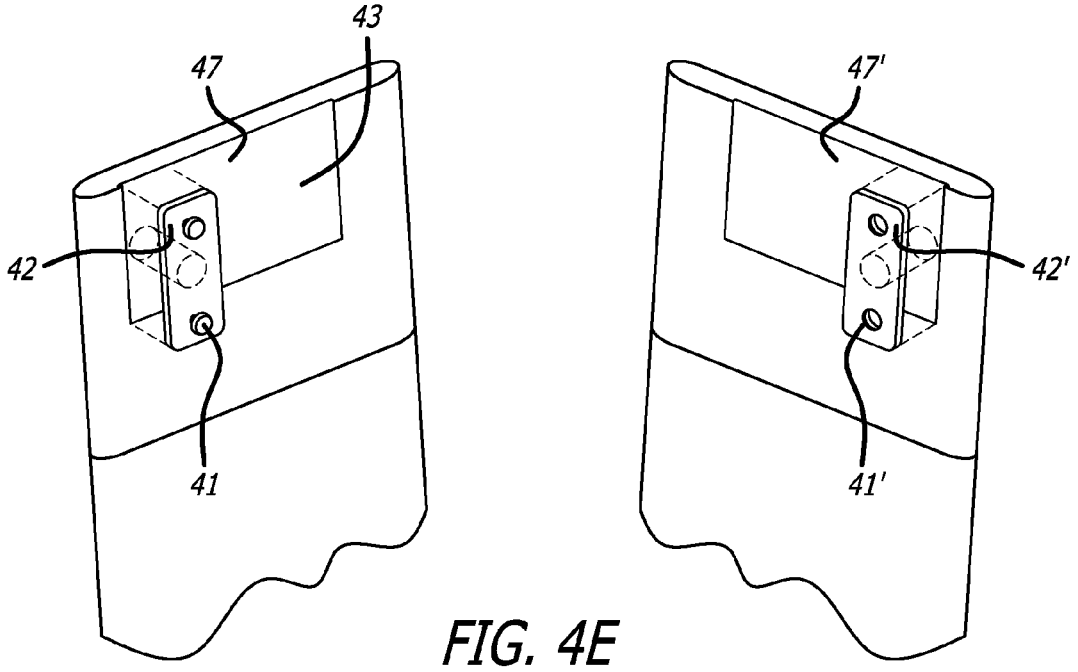
FIG. 4E is a top perspective view of a fifth exemplary embodiment of a pair of complementary articles of clothing in which the carrier and connecting elements are designed in two parts and the connecting element is attached to one end of the carrier element.
Figure 4F:
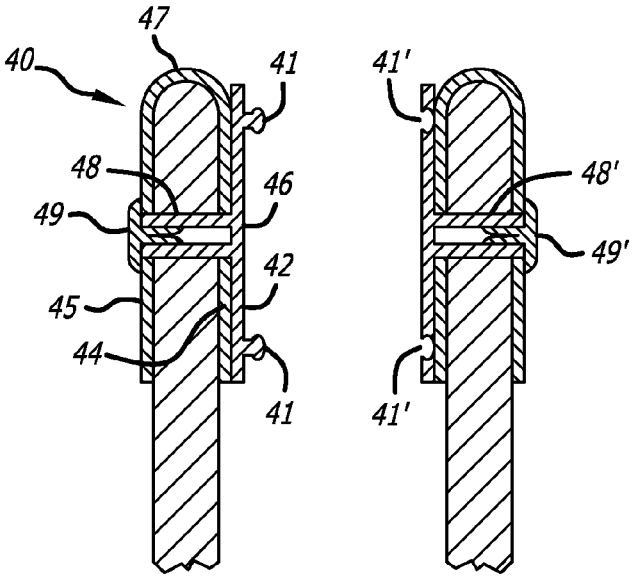
FIG. 4F is a cross-sectional side elevational view of FIG. 4E.

In the exemplary embodiment shown in FIGS. 4E and 4F, the connecting system 40 is made up in two parts from a carrier element 47, which encompasses the cuff of the sock with the fold sections 44 and 45, and a connecting element 42, which is attached to one end of the outer fold section 44. In this exemplary embodiment, the carrier element 47 is welded or heat-sealed to the sock. The part of the outer fold section 44 of the carrier element 47 next to the connecting element 42 forms the gripping area 43. The connecting element 42, which in turn has studs 41 that engage in recesses 41' of the other connecting element 42', is fastened to the carrier element 47 and to the sock, in particular with a riveted or push-fit connection.

In this exemplary embodiment, the riveted or push-fit connection can have a shaft-shaped element 48, which passes through the two fold sections 44 and 45 of the carrier element 47 and the sock, and is fastened at the inner fold section 45 by a mating element 49. Advantageously, the connecting element 42 and the shaft-shaped element 48 can be made in one piece, such as an injection-molded part, a plastic part. Alternatively, the shaft-shaped element 48 can be made as a separate element and connected to the connecting element 42.

Figure 5:
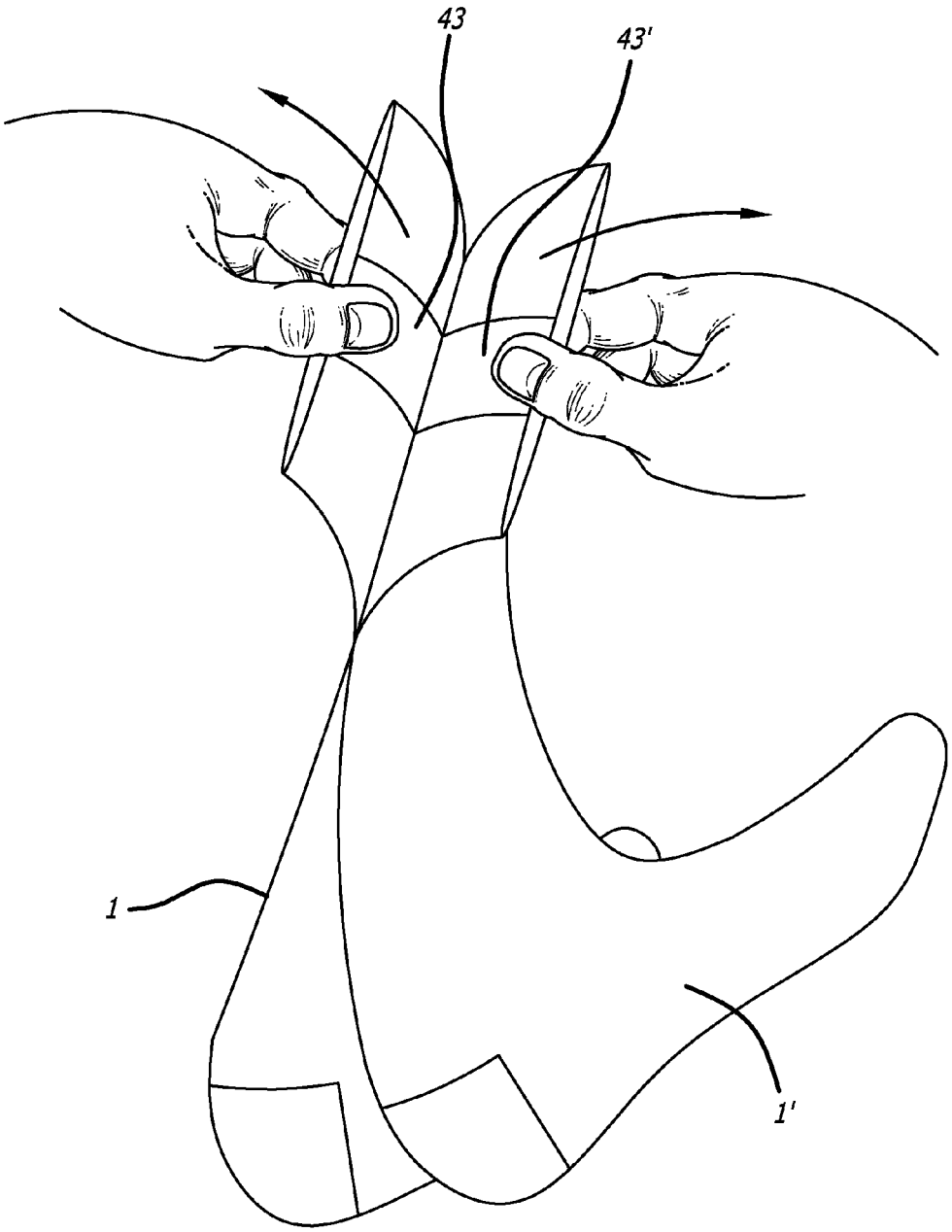
FIG. 5 is a perspective view showing the introduction of force when detaching the connection with a pair of complementary articles of clothing according to the second or third exemplary embodiments.

As can be seen from FIG. 5, the arrangement of the gripping areas 43 and 43' in the area of the cuff in turn results in unique product characteristics whereby it is readily apparent to the user where he must apply the force for detaching the connection.

Any other combinations of the alternatives for the design of carrier element and connecting element and their fastening to the sock shown in the first three exemplary embodiments are of course also conceivable and possible.

The connecting elements accordingly are designed to be complementary and produce a detachable connection, the two parts of which cannot be twisted relative to each other. This ensures that the association of the gripping areas to each other is maintained even when washing or storing so that the user takes hold of the gripping elements in order to detach the connection. On the other hand, with a twistable connection, the socks would be twisted relative to each other when washing or storing so that the user would possibly once again take hold of the knitted fabric itself in order to detach the connection. In addition, the non-twistable connection herein allows a better-fitting stacking and storing of the socks, and a better arrangement when storing, when on sale and when storing at home.

At the same time, in one preferred exemplary embodiment, they can function as a mortise and tenon joint (male/female). The non-twistable connection of the complementary connecting elements is advantageously ensured by the shape or arrangement of a mortise and tenon joint used for the connection. In doing so, use is made of either two or more rotationally-symmetrical or non-rotationally-symmetrical connecting sections, which are arranged next to each other and thus ensure the non-twistability. Alternatively or in addition, non-rotationally-symmetrical connecting sections, in particular also linear connecting sections, can also be used.

Figure 6:
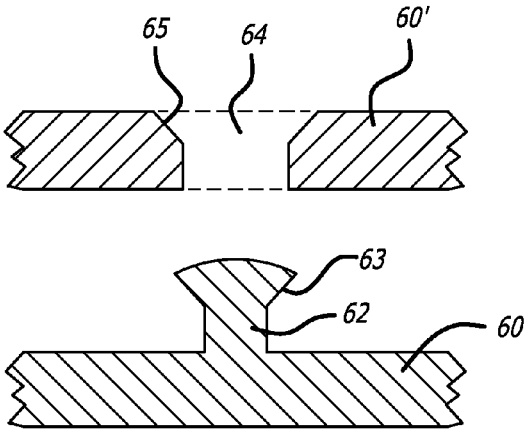
FIG. 6 shows a sectional view through the connecting sections of a pair of two complementary connecting elements.

The connection can be a mortise and tenon joint as shown schematically in section in FIG. 6. Here, a stud 62 with an undercut 63 in the shape of a mushroom head which can be pushed into a recess 64 of the second connecting element 60' is arranged on the connecting element 60. The recess 64 has a chamfer 65 that corresponds to the undercut 63. As a result of the flexible material of the connecting elements, the stud can be pushed into the recess without any problems and is fixed there in particular by the undercut. The connecting elements can be made of plastic.

Figure 7A:
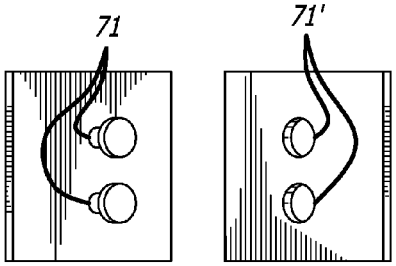
FIG. 7A shows first connecting elements with two or more connecting points for providing a non-twistable connection.
Figure 7B:
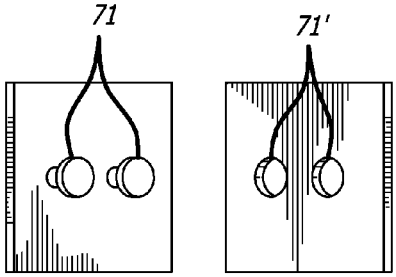
FIG. 7B shows second connecting elements with two or more connecting points for providing a non-twistable connection.
Figure 7C:
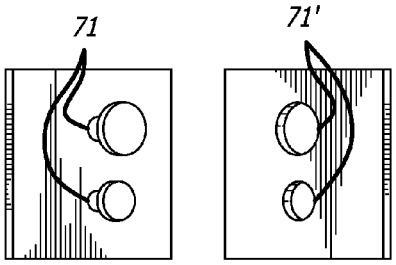
FIG. 7C shows third connecting elements with two or more connecting points for providing a non-twistable connection.
Figure 7D:
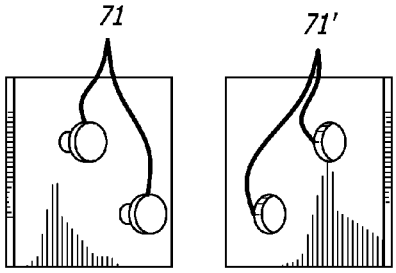
FIG. 7D shows fourth connecting elements with two or more connecting points for providing a non-twistable connection.

At the same time, connecting elements in different designs, with which in each case a plurality of rotationally-symmetrical connecting sections 71, which engage in recesses 71' are used, are shown in FIGS. 7A, 7B, 7C and 7D. The connecting points can be used in different arrangements and sizes as depicted therein. Namely, FIG. 7A shows the connection points of the same size and vertically arranged; FIG. 7B is similar to FIG. 7A but shows the connection points horizontally arranged; FIG. 7C shows, like FIG. 7A, the points being vertically aligned but the top one is larger than the bottom one; and FIG. 7D embodiment shows the points being the same size as in FIG. 7A but diagonally disposed.

Figure 8A:
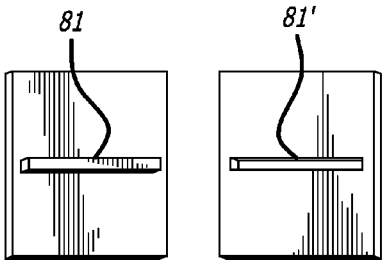
FIG. 8A shows first connecting elements with linear connecting sections for providing a non-twistable connection.
Figure 8B:
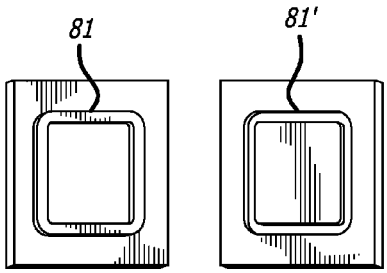
FIG. 8B shows second connecting elements with linear connecting sections for providing a non-twistable connection.

On the other hand, linear connecting sections 81 and 81' are shown in FIGS. 8A and 8B. FIG. 8A shows a horizontal linear connecting section and FIG. 8B shows a rectangular ridge with rounded corners 81 adapted to snap-fit into the rectangular recess with rounded corners 81'.

Figure 9A:
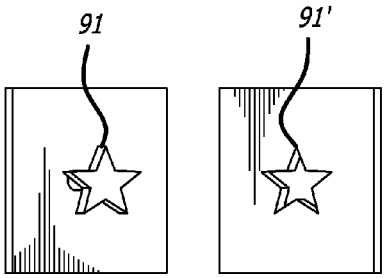
FIG. 9A shows first connecting elements with one or more non-rotationally symmetrical connecting points for providing a non-twistable connection.
Figure 9B:
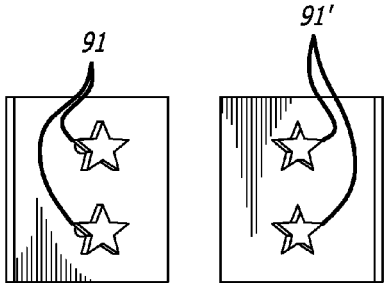
FIG. 9B shows second connecting elements with one or more non-rotationally symmetrical connecting points for providing a non-twistable connection.
Figure 9C:
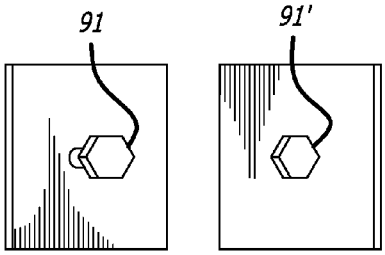
FIG. 9C shows third connecting elements with one or more non-rotationally symmetrical connecting points for providing a non-twistable connection.
Figure 9D:
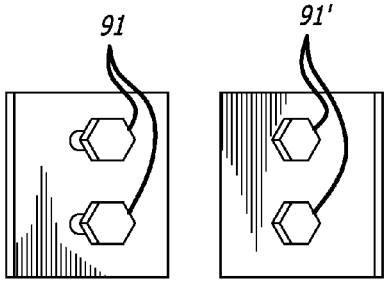
FIG. 9D shows fourth connecting elements with one or more non-rotationally symmetrical connecting points for providing a non-twistable connection.

Exemplary embodiments with other, non-rotationally-symmetrical connecting points 91 and 91' are shown in FIGS. 9A, 9B, 9C and 9D. FIG. 9A shows a single star-shaped stud 91 and a corresponding star-shaped recess 91; FIG. 9B shows two star-shaped studs 91 and two star-shaped recesses 91'; FIG. 9C shows a single hexagonally-shaped stud 91 and a corresponding hexagonally-shaped recess 91'; and FIG. 9D shows two hexagonally-shaped studs 91 and two corresponding hexagonally-shaped recesses 91'.

Advantageously, each of the two complementary connecting elements can be formed in one piece from plastic and/or metal, and carries appropriate connecting sections.

Figure 10:
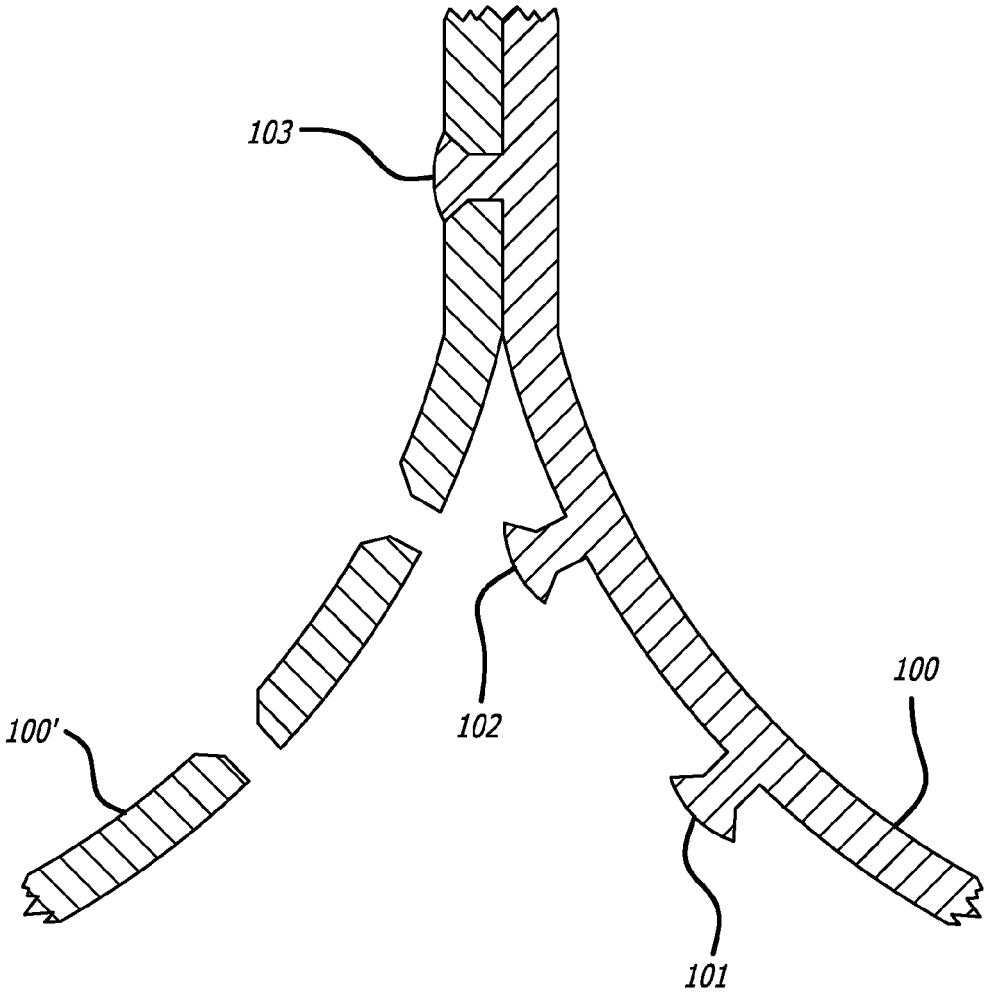
FIG. 10 is a cross-sectional view showing the distribution of points of force for a plurality of connecting sections.

In addition to the non-twistability of the connection, the use of a plurality of connecting points or linear connecting sections can also improve the distribution of the points of force. By this means, the force applied to connect and detach the socks is distributed over at least two connecting points or over the length of the linear connecting section. As a result, the user needs to exert a lower initial force when connecting or detaching. A certain redundancy of the connection is also provided, so that a reliable connection is still possible even if the connecting elements are slightly damaged. At the same time, FIG. 10 shows that, when detaching connecting elements 100 and 100' with a plurality of connecting points 101, 102 and 103, the force is distributed so that the two connecting elements can be detached more easily.

The detachable connectability of the socks enables the troublesome sorting of the socks into pairs after the washing process to be dispensed with, thereby saving time. The incorrect matching of the socks with regard to age, type, left and right socks, etc. is also avoided. Furthermore, the loss of individual socks during washing and storing is avoided.

The fastener system according to the disclosure is safe and easy to operate due to the use of gripping areas and their unique spatial association with each other which is ensured by the non-twistability of the connection. The force for connecting and detaching the connection is therefore not introduced by the user at the sock itself but rather at the carrier element. The fibers of the sock are thus not stressed or only slightly stressed when connecting and in particular also when detaching the connection, as the user does not hold the knitted fabric itself but only the carrier elements.

The disclosure provides an equally stable and easy to operate system for the detachable connection of two socks. At the same time, socks in the sense of the present disclosure are understood to mean any hosiery goods. The system for socks presented in the exemplary embodiments can also be used correspondingly for gloves, gauntlets or other complementary articles of clothing.

Although the present inventions have been described herein in terms of preferred and alternative embodiments, numerous modifications and/or additions to the above-described embodiments would be readily apparent to one skilled in the art. The embodiments can be defined as pairs of complementary articles, one or the other of the articles, a set of two carrier elements having connecting elements for a pair of complementary articles of clothing, one or the other of the carrier elements, methods of using or assembling, and/or as subassemblies or sub-methods. The inventions can include each of the individual components separately. However, it is intended that the scope of the present inventions extends to all such modifications and/or additions and that the scopes are limited solely by the claims set forth herein.

The invention claimed is:

1. A clothing assembly, comprising:

first and second complementary articles of clothing;

a connection assembly configured to detachably connect the first and second articles of clothing together;

the connection assembly including a male connector assembly attached to the first article of clothing and a female connector assembly attached to the second article of clothing;

the male connector assembly including an elongate reinforcement first strip;

the first strip having a first connection portion secured directly to fabric of the first article of clothing;

the male connector assembly including a first gripping portion;

the male connector assembly including a male connector unit attached to the first connection portion;

the male connector unit including a first plate, first and second male connector studs each having enlarged heads and extending perpendicularly out from an outward surface of the first plate, and a first receptor attached to an inward surface of the first plate;

the male connector assembly including a first male connector element configured to pass into the first receptor to secure the male connector unit to the first connection portion;

the female connector assembly including an elongate reinforcement second strip;

the second strip having a second connection portion secured directly to fabric of the second article of clothing;

the female connector assembly including a second gripping portion;

the female connector assembly including a female connector unit attached to the second connection portion;

the female connector unit including a second plate, first and second recesses on an outward surface of the second plate, and a second receptor attached to an inward surface of the second plate;

the female connector assembly including a second male connector element configured to pass into the second receptor to secure the female connector unit to the second connection portion;

the first and second recesses being configured to snap-fit receive therein the respective enlarged heads of the first and second male connector studs so that the male and female connector assemblies produce a non-twistable connection between the first and second articles of clothing and the first and second gripping portions remain spaced from one another, and the connection being configured to be detachable by a user grasping the first and second gripping portions and pulling the first and second articles of clothing apart; and the first receptor passing through the first connection portion, and the second receptor passing through the second connection portion.

2. The clothing assembly of claim 1 wherein the first receptor extends outwardly from the inward surface of the first plate, and the second receptor extends outwardly from the inward surface of the second plate.

3. The clothing assembly of claim 1 wherein the first gripping portion is part of the first strip and is secured directly to the fabric of the first article of clothing, and the second gripping portion is part of the second strip and is secured directly to the fabric of the second article of clothing.

4. The clothing assembly of claim 1 wherein the male connector unit is an injection molded unit with a first portion thereof being formed of a first plastic and a second portion thereof being formed of a different second plastic.

5. The clothing assembly of claim 1 wherein the first male connector element includes a first head and a first stud extending out therefrom for insertion into the first receptor at an end opposite to the first plate, and the second male connector element includes a second head and a second stud extending out therefrom for insertion into the second receptor at an end opposite to the second plate.

6. The clothing assembly of claim 1 wherein the first and second articles of clothing comprise a pair of socks.

7. The clothing assembly of claim 1 wherein the first male connector element includes a first head and a first stud extending out therefrom for insertion into the first receptor at an end opposite to the first plate, and the second male connector element includes a second head and a second stud extending out therefrom for insertion into the second receptor at an end opposite to the second plate.

8. The clothing assembly of claim 1 wherein the first strip extends longitudinally relative to the first article of clothing and the first gripping portion is distal relative to the first connection portion and the second strip extends longitudinally relative to the second article of clothing and the second gripping portion is distal relative to the second connection portion.

9. The clothing assembly of claim 1 wherein the first strip is sewn to the fabric of the first article of clothing and the second strip is sewn to the fabric of the second article of clothing.

10. A clothing assembly, comprising:

first and second complementary articles of clothing;

a connection assembly configured to detachably connect the first and second articles of clothing together;

the connection assembly including a male connector assembly attached to the first article of clothing and a female connector assembly attached to the second article of clothing;

the male connector assembly including an elongate reinforcement first strip;

the first strip having a first connection portion secured directly to fabric of the first article of clothing;

the male connector assembly including a first gripping portion;

the male connector assembly including a male connector unit attached to the first connection portion;

the male connector unit including a first plate, first and second male connector studs each having enlarged heads and extending perpendicularly out from an outward surface of the first plate, and a first receptor attached to an inward surface of the first plate;

the male connector assembly including a first male connector element configured to pass into the first receptor to secure the male connector unit to the first connection portion;

the female connector assembly including an elongate reinforcement second strip;

the second strip having a second connection portion secured directly to fabric of the second article of clothing;

the female connector assembly including a second gripping portion;

the female connector assembly including a female connector unit attached to the second connection portion;

the female connector unit including a second plate, first and second recesses on an outward surface of the second plate, and a second receptor attached to an inward surface of the second plate;

the female connector assembly including a second male connector element configured to pass into the second receptor to secure the female connector unit to the second connection portion;

the first and second recesses being configured to snap-fit receive therein the respective enlarged heads of the first and second male connector studs so that the male and female connector assemblies produce a non-twistable connection between the first and second articles of clothing and the first and second gripping portions remain spaced from one another, and the connection being configured to be detachable by a user grasping the first and second gripping portions and pulling the first and second articles of clothing apart; and the first receptor being formed on the inward surface of the first plate and the second receptor being formed on the inward surface of the second plate.

11. The clothing assembly of claim 10 wherein the first receptor is a first tube and the second receptor is a second tube.

12. The clothing assembly of claim 10 wherein the first gripping portion is part of the first strip and is secured directly to the fabric of the first article of clothing, and the second gripping portion is part of the second strip and is secured directly to the fabric of the second article of clothing.

13. The clothing assembly of claim 10 wherein the first receptor and the first plate are formed as an injection-molded first unit and the second receptor and the second plate are formed as an injection-molded second unit.

14. The clothing assembly of claim 10 wherein the first and second articles of clothing are a pair of socks.

15. The clothing assembly of claim 10 wherein the first strip is sewn to the fabric of the first article of clothing and the second strip is sewn to the fabric of the second article of clothing.

16. The clothing assembly of claim 10 wherein the first strip extends longitudinally relative to the first article of clothing and the first gripping portion is distal relative to the first connection portion and the second strip extends longitudinally relative to the second article of clothing and the second gripping portion is distal relative to the second connection portion.

17. The clothing assembly of claim 10 wherein the first male connector element includes a first head and a first stud extending out therefrom for insertion into the first receptor at an end opposite to the first plate, and the second male connector element includes a second head and a second stud extending out therefrom for insertion into the second receptor at an end opposite to the second plate.

18. The clothing assembly of claim 10 wherein the first strip extends longitudinally relative to the first article of clothing and the first gripping portion is distal relative to the first connection portion and the second strip extends longitudinally relative to the second article of clothing and the second gripping portion is distal relative to the second connection portion.

19. The clothing assembly of claim 10 wherein the first strip is sewn to the fabric of the first article of clothing and the second strip is sewn to the fabric of the second article of clothing.

20. A clothing assembly, comprising:

first and second complementary articles of clothing;

a connection assembly configured to detachably connect the first and second articles of clothing together;

the connection assembly including a first connector attached to the first article of clothing and a second connector attached to the second article of clothing;

the first connector including a first flexible carrier strip having a first connection portion secured directly to fabric of the first article of clothing and a first gripping portion;

the first connector including a male connector unit;

the male connector unit including a first base plate secured directly to the first connection portion and first and second male connector studs secured to an outward surface of the first base plate and each stud having an enlarged head, a first receptor secured to an inward surface of the first base plate, and a first male connector element configured to pass into the first receptor to secure the male connector unit to the first connection portion;

the second connector including a second flexible carrier strip having a second connection portion secured directly to fabric of the second article of clothing and a second gripping portion;

the second connector including a female connector unit;

the female connector unit including a second base plate secured directly to the second connection portion and first and second recesses on an outward surface of the second base plate, a second receptor secured to an inward surface of the second base plate, and a second male connector element configured to pass into the second receptor to secure the female connector unit to the second connection portion, the first and second recesses being configured to receive therein the respective enlarged heads of the first and second male connector studs so that the first and second connectors produce a non-twistable connection between the first and second articles of clothing and with the first and second gripping portions being in a spaced relationship, and the connection being configured to be detachable by a user grasping the spaced first and second gripping portions and pulling them apart to thereby separate the first and second articles of clothing; and the first receptor being a first tube and the second receptor being a second tube.

21. The clothing assembly of claim 20 wherein the first gripping portion is not directly connected to the fabric of the first article of clothing and extends in a cantilever-manner a distance out from an edge of the first article of clothing and thereby forms a user-grippable first tab; and the second gripping portion is not directly connected to the fabric of the second article of clothing and extends in a cantilever-manner a distance out from an edge of the second article of clothing and thereby forms a user-grippable second tab.

22. The clothing assembly of claim 20 wherein the first and second articles of clothing comprise a pair of socks.

23. The clothing assembly of claim 20 wherein the single plastic piece includes one portion formed of a first plastic and another portion formed of a different second plastic which forms a graphic.

24. The clothing assembly of claim 20 wherein the first receptor extends outwardly from the inward surface of the first plate, and the second receptor extends outwardly from the inward surface of the second plate.

25. The clothing assembly of claim 20 wherein the first receptor passes through the first connection portion, and the second receptor passes through the second connection portion.

26. The clothing assembly of claim 20 wherein the first receptor is formed on the inward surface of the first plate and the second receptor is formed on the inward surface of the second plate.

* * * * *